United States Patent [19]

Parish

[11] 4,390,181

[45] Jun. 28, 1983

[54] PRACTICE PITCHING APPARATUS

[76] Inventor: Max M. Parish, P.O. Box 86, French Lick, Ind. 47432

[21] Appl. No.: 138,295

[22] Filed: Apr. 8, 1980

[51] Int. Cl.[3] ..... A63B 69/40

[52] U.S. Cl. ..... 273/26 A; 340/323 R

[58] Field of Search ..... 273/26 A, 29 R, 29 A, 273/1 E, 1.5 A, 88, 286 A, 376, 323 R, 371, 183 R, 181 R, 374; 340/323 R

[56] References Cited

U.S. PATENT DOCUMENTS

| | | | |
|---|---|---|---|
| 1,018,409 | 2/1912 | Culp | 273/374 |
| 2,040,228 | 5/1936 | Whiteley | 273/26 A |
| 2,087,575 | 7/1937 | Littell et al. | 273/29 A |
| 2,657,931 | 11/1953 | Burrell | 273/26 A |
| 2,899,052 | 6/1959 | Burrell | 273/26 A |
| 3,133,733 | 5/1964 | Elseroad | 273/26 A |
| 3,157,399 | 11/1964 | Gaudet | 273/26 A |
| 3,206,196 | 9/1965 | Jackson | 273/26 A |
| 3,229,975 | 1/1966 | Tompkins et al. | 273/371 |
| 3,427,026 | 2/1969 | Mahoney | 273/26 A |
| 3,706,451 | 12/1972 | Dixon | 273/26 A |
| 3,997,158 | 12/1976 | Button | 273/26 A |
| 4,199,141 | 4/1980 | Garcia | 273/26 A |

*Primary Examiner*—Richard C. Pinkham
*Assistant Examiner*—T. Brown
*Attorney, Agent, or Firm*—Woodard, Weikart, Emhardt & Naughton

[57] ABSTRACT

A practice pitching apparatus for identifying whether a ball pitched would be considered a strike or a ball based upon delineation of a strike area and a ball area on an upright target. The apparatus includes a frame member oriented in an upright position with a forward-facing front surface segmented into a recessed strike zone impact panel and a surrounding ball zone arrangement of impact panels. Disposed behind each impact panel is a paired arrangement of switches which are coupled to ball-counting circuitry and strike-counting circuitry. A display with a series of lights is provided for a continuously visible indication of how many balls, strikes, walks and outs have been delivered. When the third out is recorded, the entire system is reset signifying the end of an inning and the pitcher begins anew. The ball-counting circuitry and strike-counting circuitry are cooperatively arranged with respect to each other such that when the third strike is delivered, the ball count resets to zero and when the fourth ball is delivered, the strike count resets to zero. The switches are arranged such that if the ball zone impact panel is first hit, one of the two switches records the ball count and the other switch of the pair disables the strike count circuitry so that ricocheting shots will not count twice.

2 Claims, 6 Drawing Figures

PRACTICE PITCHING APPARATUS

BACKGROUND OF THE INVENTION

This invention relates in general to practice pitching apparata and in particular to such apparata which provide a count indication of balls, strikes, walks and outs.

Over the years a number of attempts have been made to provide devices and apparata in order to enable one to practice baseball pitching whether for serious practice or as part of a game. Typically, the apparata include some type of backstop arrangement which the pitcher propels the ball toward and the location that the ball strikes is then evaluated by the pitcher or alternatively by the system which provides an indication of whether the pitch delivered was a ball or a strike. Most systems stop at this point, merely indicating whether a ball or a strike was thrown. While some systems provide a ball and strike count based on consecutive pitches, a number of the earlier systems are concerned with specifically where the pitch was delivered such as high, low, inside or outside. The two most common methods employed for determining whether a pitch is a ball or a strike involve the use of electromechanical switching components or alternatively, a photoelectric arrangement where the light path is disrupted by the ball passing therethrough and by that means enable the associated circuitry to determine the location of the pitch.

The systems which are oriented primarily around a game concept are quite often juvenile in nature and do not promote serious pitching attempts nor do they simulate a real game atmosphere. As to those systems which count balls and strikes, their circuitry goes no further. These systems do not continue the count into walks and outs. If a system would be arranged to convert balls and strikes into walks and outs, the system must include means to reset the corresponding ball or strike circuitry to begin anew. Many of the present systems also employ a mechanical arrangement which is subject to erroneous data by allowing the ball to ricochet or deflect and record a double response. Still further systems employ a rebounding backstop arrangement such that pitches delivered quite hard rebound rapidly and can present a potential hazard to the pitcher. Although this type of system might simulate a real game atmosphere such as when a pitch is hit sharply back to the pitcher's mound, it is preferred that this not occur when one is solely concentrating on delivering pitches and is not concentrating on fielding practice at the same time.

The systems incorporating a photoelectric cell arrangement are felt to be a disadvantage because of the type and number of electrical components required and the fact that they must be located accurately around the framework of the backstop and would be subject to being struck by a wild or errant pitch. Althouth such components could be securely encased, such protective measures would unduly complicate the apparatus as well as increase its cost and reduce its portability.

Following is a listing of various prior attempts at developing a practice pitching or target game system and although each may have provided some benefit or improvement at the time of their conception, none are believed to render the same advantages as the present invention nor are they felt to anticipate or otherwise render the present invention obvious.

| Patent No. | Patentee | Issue Date |
|---|---|---|
| 3,206,196 | Jackson | 9/14/65 |
| 3,997,158 | Britton | 12/14/76 |
| 3,706,451 | Dixon | 12/19/72 |
| 3,427,026 | Mahoney | 2/11/69 |
| 3,229,975 | Tompkins et al. | 1/18/66 |
| 3,133,733 | Elseroad | 5/19/64 |
| 2,890,052 | Burrell | 6/09/59 |
| 2,657,931 | Burrell | 11/03/53 |
| 2,040,228 | Whiteley | 5/12/36 |
| 3,157,399 | Gaudet | 11/17/64 |

Jackson discloses a target device at which baseballs may be thrown and the accuracy of the hit upon the target is recorded by two sets of lights, one for strikes and one for balls. There is a strike zone and a separate surrounding ball zone with an elastic covering such that the ball thrown will be returned to the pitcher in a rebounding type of action.

Britton discloses a strike zone target for the aid of youngsters and others learning to play baseball or practicing to improve their game. The construction involves two vertical chains spaced wider than home plate is wide and two horizontal chains with a hook at each end and the hooks are adapted to be removably fastened at different heights to the vertical chains for drawing these vertical chains together. The use of these chains thereby defines the particular strike zone for the person to throw at. There is no circuitry associated with this arrangement for counting balls and strikes and the device is purely a mechanical arrangement.

Dixon discloses a target-type scoring device which includes a target formed of resilient material such as a net supported by elastic members and a frame. There is a plate positioned in spaced relationship behind the target and this plate includes markings thereon to define a scoring area and to indicate a score resulting from the scoring area of the target being struck by an object.

Mahoney discloses a projectile return apparatus and the structure is one of a purely mechanical arrangement whereby an elastic cover may be variously oriented by means of its cooperating frame structure so that its angle of inclination can be varied and thereby vary the trajectory of the returning projectile.

Tompkins et al. discloses an electronic pitching aid consisting of a criss-crossing light beam pattern created by a spaced series of photoelectric cells. A series of vertical light paths and a series of horizontal light paths intersect one another in what is designated as the strike zone and the accuracy of the thrown strike will be recorded by its intersection location. There are no counting means nor circuitry to maintain balls, strikes, walks and outs.

Elseroad discloses an amusement device for simulating certain elements of the game of baseball in order to amuse a small child and to provide a target at which to throw a ball. The device includes two targets, one for simulation of the strike zone for a batter at which a rubber ball may be thrown, and the other is a simulation of the first baseman to whom the ball is thrown after it is hit. Other than indicating whether a thrown pitch is a hit or an out, the system does not involve circuitry to count balls and strikes.

Burrell ('052) discloses a target with an electrical indicator designed to record the accuracy of the hit on the target. The target is a disc-like member pivotally supported on a shaft such that upon impact by a thrown ball, the disc will revolve and the closer the hit is to the shaft, the less rocking or tilting there would be and correspondingly, the greater accuracy of the thrown ball will be indicated.

Burrell ('931) discloses a target baseball game of the type with facilities for playing the game of baseball to a large extent and is intended as a simulation of an actual baseball game where the success of each play depends in part on the pitching skill of the player. One aspect of this device involves a target which is divided into marked fields that represent various favorable and unfavorable plays in regulation baseball and the determination of whether or not a favorable or unfavorable play results is based upon the accuracy of the individual throwing the baseball at one of these particular marked fields. There is no electronic circuitry associated with this device for counting balls, strikes, walks and outs.

Whiteley discloses a baseball pitching game of the type that incorporates a target and a plurality of generally square plungers disposed in the designated strike zone and contact with these plungers by the thrown ball results in the closing of a switch and the illumination of a light. There is no light illumination if a ball is thrown and there is no circuitry to consecutively count balls and strikes and continue the count into walks and outs.

Gaudet discloses a baseball pitching practice target with ball and strike indicators and is constructed of a frame arrangement including an outer surface of vertical cords and a parallel spaced inner surface of horizontal cords. Selected cords of the vertical group and selected cords of the horizontal group are coupled to switches and are spaced appropriately such that the switches are tripped when a baseball passes through adjacent pairs of cords. The horizontal and vertical cords which are connected to the switches are arranged into a major pattern defining a strike zone such that when a ball is thrown and trips both a horizontal and a vertical cord, a strike indication is presented. Alternatively, when a ball is thrown and only passes through one set of cords, a ball indication results. There is an electrical circuit and a counter to count total balls and total strikes but there is no compatible circuitry to convert balls into walks nor strikes into outs, nor to recycle the entire system at the conclusion of an inning.

While each of these various listed devices are probably workable, they are not believed to provide an optimal set of characteristics. When an individual is practicing pitching, there are number of factors which play upon both game strategy and his psychological conditioning. A pitcher who is throwing hard and accurately may actually become emotionally high and continue to perform in an outstanding manner. In a similar light, a pitcher who starts off struggling may try too hard to correct his errant ways resulting in a pitching performance that is even more erradic and wild. Game conditions may also have an effect over a pitcher such as the number of outs, number of walks, and the score in the game. Unless such conditions can be simulated in a very accurate and realistic manner, any practice pitching device is not believed to be ideal. A further concern in the design of such a practice pitching apparatus is that the pitcher be allowed to throw fast and hard without the device acting as a rebounding wall or forcing the pitcher to go to great extremes to attempt to retrieve pitches. Systems which are of an elastic cover in nature and which result in a thrown pitch rebounding back to the pitcher are not believed to be desirable under these circumstances. Although some pitches may be hit back to the pitcher, the majority of pitches are caught by the catcher. Furthermore, a pitching device which allows thrown balls to pass through or otherwise end up in varied locations requires additional time and effort to collect the base balls which have been thrown. A further concern with a system which consecutively counts balls and strikes is the need to prevent a thrown pitch from ricocheting or rebounding from a strike zone into a ball zone or vice versa and making a double count entry into the counting system when in fact only one pitch has been thrown. A further advantage of such systems would be to provide counting circuitry in order to convert the fourth ball into a walk and the third strike into an out and to recycle the entire system after the third out in order to indicate the end of an inning. Such a counting system would more accurately simulate actual game conditions and is believed to be superior to any existing disclosure or apparatus. The invention disclosed herein provides each of these various benefits and advantages and is believed to be novel and unobvious.

SUMMARY OF THE INVENTION

A practice pitching apparatus for identifying a thrown pitch as a ball or a strike and consecutively counting the number of balls and strikes according to one embodiment of the present invention comprises an upright target member having a front surface arranged into a strike zone and a surrounding ball zone, a strike-counting circuit section responsive to baseball impact on said strike zone, an out-counting circuit section coupled to and in cooperation with said strike-counting circuit section, a ball-counting circuit section responsive to said baseball impact on said ball zone and display means for indicating the number of strikes and balls thrown.

One object of the present invention is to provide an improved practice pitching apparatus.

Related objects and advantages of the present invention will be apparent from the following description.

DESCRIPTION OF THE PREFERRED EMBODIMENT

Figure 1:
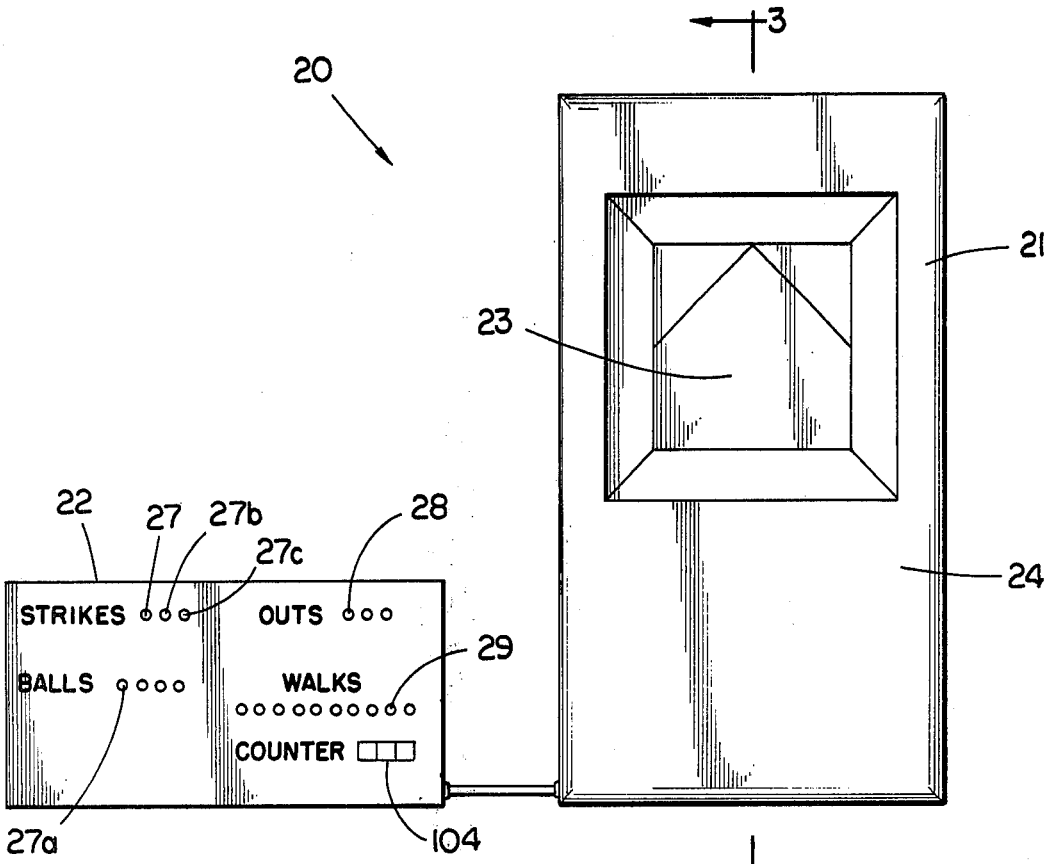
FIG. 1 is a front elevation view of a practice pitching apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated practice pitching apparatus 20 which includes an upright target member 21 and display circuitry 22. The upright target member is arranged into a strike zone area 23 and a surrounding ball zone area 24. The display circuitry 22 includes four separate circuit sections, one each for counting balls, strikes, walks and outs. As the individual who is practicing throwing pitches stands before the upright target member, the intent is to deliver a strike. By propelling the ball so that it hits the strike zone area 23, arranged into the shape of home plate, the associated circuitry will record the pitch as a strike. If the baseball is delivered such that it strikes the surrounding ball zone area 24, the switch circuitry therebehind (see FIGS. 2 and 3), electrically provides an indication of this pitch to display circuitry 22 by means of the ball-counting circuit section. Once the particular pitch is identified and counted, light 27 or 27*a* will be illuminated indicating that one strike or one ball, respectively, has been thrown. Additional strikes which are thrown will similarly be counted by the remaining two lights 27*b* and 27*c* until such time as the first out is recorded. When light 28 becomes illuminated, the previously illuminated three strike lights will go out and strike recounting then continues until the second out and then again until the third out. Once the third out has been made, the entire circuit arrangement resets itself to indicate the end of one inning and everything begins anew.

The ball-counting circuitry is virtually the same as the strike-counting circuitry and walks are also indicated by their own series of lights 29 after every fourth ball is delivered. It is also to be pointed out that display circuitry 22 includes means for resetting the ball count to zero once the third strike is thrown as well as resetting the strike count to zero once the fourth ball is thrown. There is no resetting provision for consecutive walks, thus it is possible to walk in runs.

Figure 2:
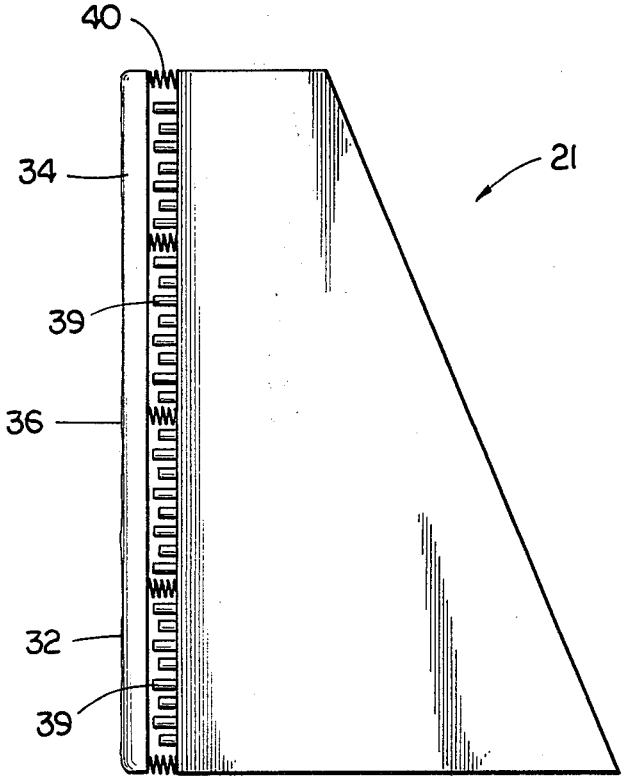
FIG. 2 is a side elevation view of the FIG. 1 practice pitching apparatus.
Figure 3A:
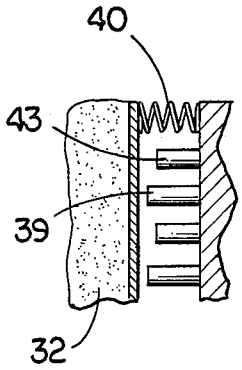
FIG. 3*a* is a partial, detailed, side elevation view of the FIG. 1 practice pitching apparatus.
Figure 3:
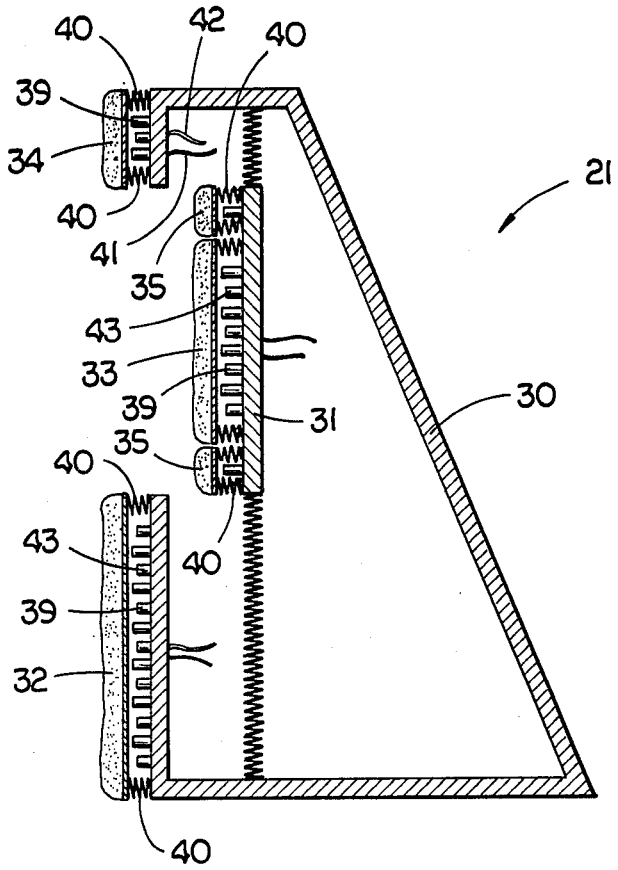
FIG. 3 is a side elevation section view of the FIG. 1 practice pitching apparatus as taken along line 3—3 in FIG. 1.

FIGS. 2 and 3 illustrate the strike zone area and ball zone area in greater detail. As can be seen from these figures, the upright target member 21 includes a frame portion 30, a suspended strike zone plate 31 and a plurality of spring-biased impact panels 32–36. Secured to frame 30 is a plurality of momentary pushbutton contact switches 39 which are disposed perpendicular to and immediately and directly behind each of the various impact panels. Spring members 40 offset the impact panels slightly above the top surface of the momentary switches and the spring constant of these spring members is selected so that upon impact by a pitched baseball, the impact panel deflects inwardly a sufficient distance to energize the corresponding momentary switch. Representative wires 41 and 42 are shown to diagrammatically illustrate the wiring connection of these momentary switches 39 to display circuitry 22. The switches are wired in parallel such that only one need be triggered for a corresponding count.

Inasmuch as a variety of mile-per-hour and force ranges may exist with different types of pitchers, the spring members need to be selected in combination with the pushbutton travel distance of the switch in order to accommodate the range of forces to be anticipated. For example, a pitch thrown at 85 or 90 miles an hour will result in a particular force on impact. Similarly, a pitch thrown at 20 or 25 miles per hour will result in a significantly lower force at impact. By selection of a suitable spring constant and switch design, apparatus 20 can be arranged such that the higher force will suitably deflect the impact panel and cause the pushbutton switch to be energized with the same result occurring at the lower force level. To prevent overdriving or damaging the pushbutton switches, a stop member 43 (see FIG. 3*a*) is provided. Such a stop member has a protruding length just short of the point at which the inward travel of the pushbutton energizes the switch so that even with a high force level on impact, the pushbutton portion of the switch cannot be depressed beyond its normal operating extremes. If the force is excessive, then the panel's continued advancement into the switch will be stopped by member 43. Although springs are actually illustrated in FIGS. 2 and 3, it is to be understood that any of a variety of rubber compounds and shock absorber-type arrangements would be equally well suited for this particular application and the illustration of a spring is as much for diagrammatic purposes as it is for indicating specific hardware.

A further feature of apparatus 20 involves a selective pairing of switching 39 together, depending upon whether the pair of switches are located in the strike zone or in the ball zone. Each pair of switches 39 is arranged with one switch in a normally open condition and the other in a normally closed condition. Each switch is a momentary contact switch. The purpose of this arrangement is to prevent a ball which strikes the impact panel in the ball zone from ricocheting and also hitting the corresponding impact panel in the strike zone and thereby trigger two switches and give a double reading. When the baseball is thrown and strikes an impact panel corresponding to the ball zone area, at least one pair of adjacent switches will be actuated. One switch of this pair activates the ball-counting circuit section in order to record that a ball has been thrown. The second switch of the pair of switches immediately breaks the strike-count circuit section so that if the thrown baseball ricochets onto an impact panel in the strike zone, the strike-count circuitry is ineffective to record the ricocheting ball as a strike. The reverse situation is true for those impact panels and pairs of switches in the strike zone area. This disabling condition only lasts for a brief interval of time and once the appropriate ball or strike count has been registered, all impact panels and pairs of switches 39 return to their normal condition and are again ready to receive and record the next pitch which is thrown. This recycling time is considerably shorter than the time it takes for another pitch to be thrown.

It is important that the strike zone area be offset and segmented from the ball zone area as is illustrated in FIG. 3. If this was not the case, then the impact panels for the ball zone and the impact panels for the strike zone would be contiguous to one another and a pitch thrown at the line of interface could activate both the circuits due to the simulatneous nature of the impact. By offsetting the two zones and their corresponding impact panels, the only way for such double actuation is by ricocheted shot and this possibility has already been anticipated and taken care of by the designed arrangement and circuitry provided. As can be seen then, the thrown balls will either record a ball or a strike and the arrangement of the impact panels and their spring members can be tailored so as to act as a shock absorber and in addition to recording the type of pitch which was thrown, these panels and spring members serve to stop the ball and act as a momentum-deadening backstop. In this manner, the outer surface of the impact panels is made of a material which is absorbent to impact and of a sufficient durability and strength so as not to crack, chip or tear. There are a variety of synthetic materials and compounds suitable for this purpose and it is preferred that a material of this nature be utilized rather than metal or wood. Such synthetic materials are also an advantage in that they reduce the overall weight of the apparatus and allow it to be easily moved from position to position or transported.

Figure 4A:
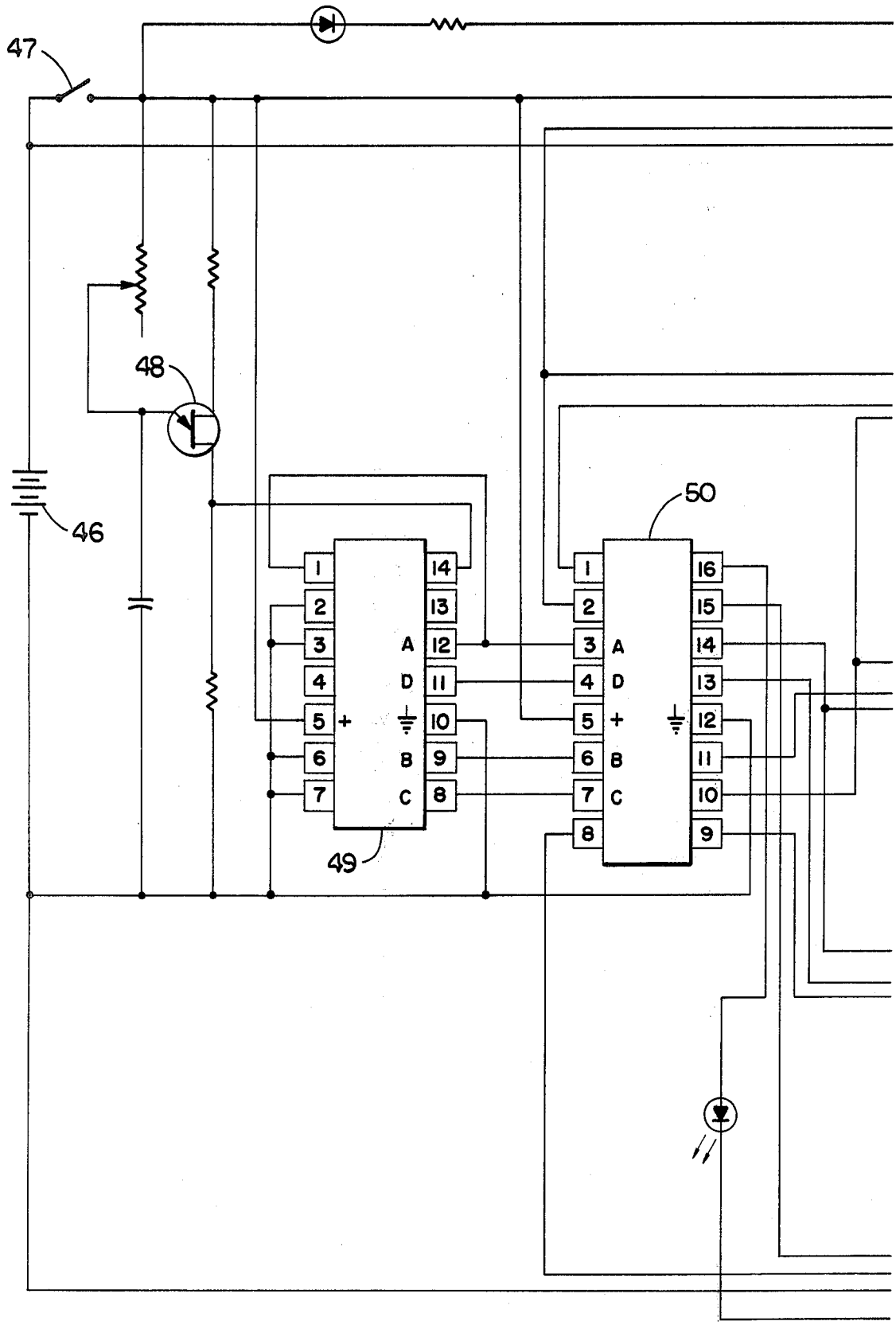
FIGS. 4*a* and 4*b* combined are a schematic diagram of strike and out-counting circuitry.
Figure 4B:
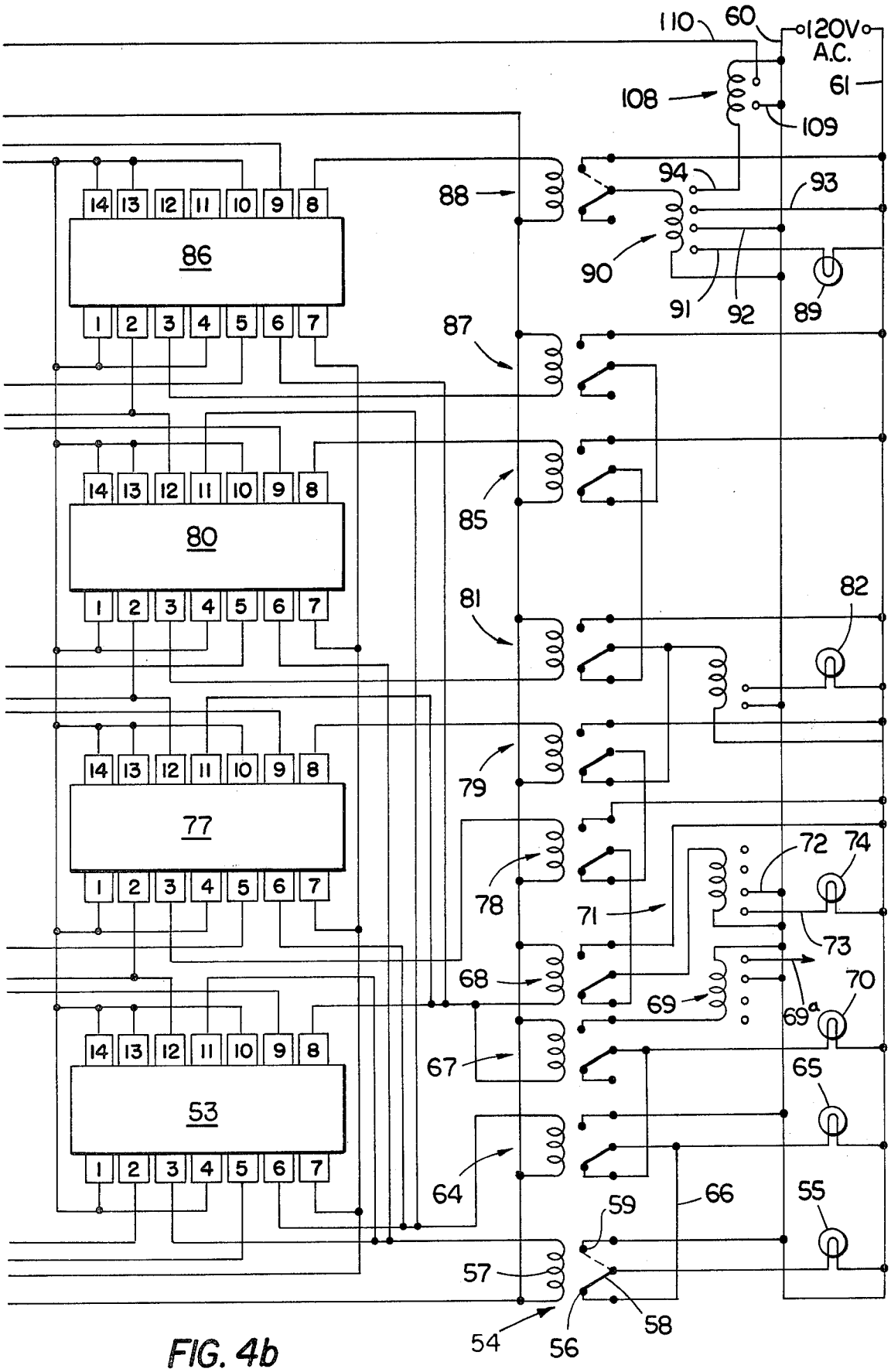
Figure 5:
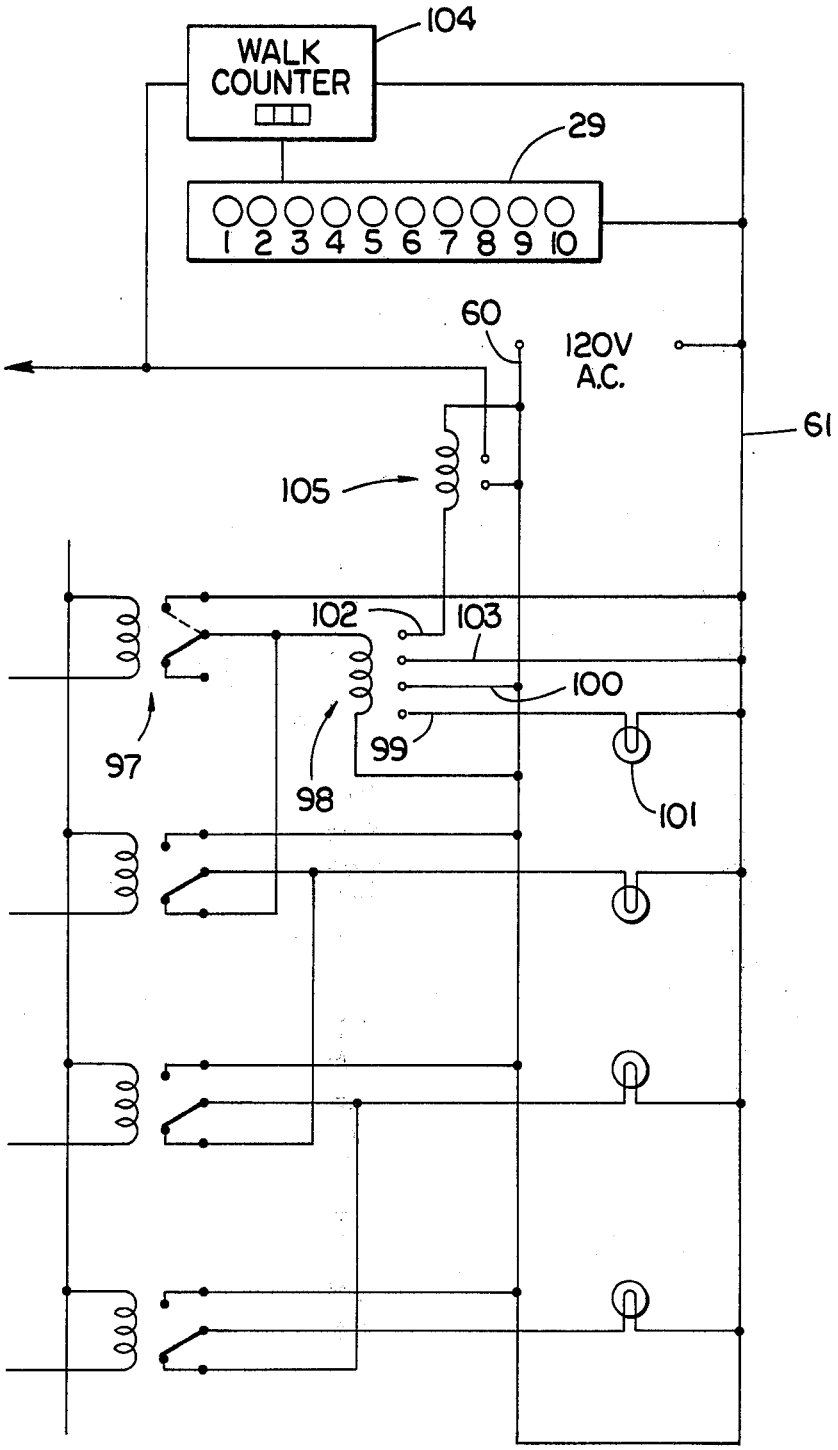
FIG. 5 is a schematic diagram of additional circuitry required for counting balls and walks.

Referring to FIGS. 4 and 5, the associated circuitry is illustrated. It is to be understood initially that although FIG. 4 focuses primarily on the counting of strikes and outs, virtually identical circuitry is utilized for counting balls and walks. In this regard, it should be understood that the concepts are the same and the determinant as to whether a pitch is recorded as a ball or a strike depends upon the location of impact and not the particular circuit section. There is one minor difference in that once the fourth ball is thrown a walk will be indicated and the portion of circuitry to provide this capability is illustrated in FIG. 5.

The counting and display circuitry provided by FIG. 4 includes a 6-volt DC power source such as a battery 46. Upon closing switch 47, a voltage pulse is sent through transistor 48 which in turn sends the pulse to pin 14 of integrated circuit (IC) 49. IC 49 is a 7490 flip-flop binary-coded decimal counter and the pulse in at pin 14 changes this flip-flop from one state to the next state. This pulse leaves IC 49 via pin 12 on through to pin 3 of IC 50 which is a 7441 BCD-to-decimal decoder. The voltage pulse continues from this point through the entire circuit to set the machine ready for play condition.

Although switch 47 represents means for initial setting of the strike count circuitry, this switch also symbolicly represents the triggering switch for each strike ball which is thrown. In this regard, switches 39 provide the triggering pulse and the closing of a strike switch of the switches 39 is effectively the closing of switch 47. Each time that switch 47 is triggered, it sends a pulse through transistor 48 on to pin 14 of IC 49 in order to trigger the flip-flop from A to B. The pulse from B (pin 9) connects to pin 6 of IC 50 and from pin 6 to pin 15. The pulse out from pin 15 couples to pin 2 of IC 53. The pulse in on pin 2 of IC 53 is output from pin 3 in order to trigger relay 54 which in turn switches on the current to light 55. Light 55 represents, in one circuit arrangement, the first strike and in the compatible circuit arrangement the first ball. Since light 55 is generic to both circuit sections, it retains a new reference number, but it should be understood that light 55 and the other lights of FIGS. 4 and 5 correspond to those lights of FIG. 1 (namely 27, 27*a*, 27*b*, 27*c*, 28 and 29. For the purposes of explanation and discussion herein, the circuit diagram of FIG. 4 will be hereinafter referred to as the strike-counting circuit section and the out-counting circuit section, it being understood that virtually identical circuitry is used to count balls and walks. IC 53 is a 7408 quad 2-input AND gate.

Relay 54 is a make and hold relay which is in a normally closed position against contact 56. When coil 57 is energized by the signal from pin 3 of IC 53, relay 54 switches to an energized condition at which time arm 58 is switched to contact 59. This closes the circuit provided by lines 60 and 61 and energizes light 55. Lines 60 and 61 can be thought of the two lines associated with a common electrical plug and as such would be inserted into a conventional wall outlet in order to provide power for the illumination of the lights.

The next time switch 47 is triggered (by baseball impact on one of the panels), the pulse again travels through transistor 48 into pin 14 of IC 49 and then changes the flip-flop from B to C. The output from pin 8 of IC 49 couples to pin 7 of IC 50 and is outputted from IC 50 on pin 8. This pulse then enters on pin 5 of IC 53 and is in turn outputted from pin 6 and energizes relay 64 in virtually the same manner as relay 54 was energized for the illumination of light 55. Once the arm of relay 64 switches state, light 65 illuminates and indicates that a second pitch of the same nature as the first has been received. In the illustrated circuitry, this denotes that two strikes have now been pitched. The internal circuitry of IC 53 is such that relay 54 remains effectively in an energized condition and light 55 remains illuminated by a circuit path through contact 59 until the second strike pitch is recorded. With the second pulse to IC 53 relay 64 is energized as relay 54 is deenergized, and although relay 54 returns to its original closed position against contact 56, a connection by way of line 66 maintains light 55 in an illuminated condition so that both lights 55 and 65 are illuminated.

Once again, when switch 47 is triggered, the pulse continues through in much the same manner as has previously been described for the first two strikes and in this case changes IC 49 from C to D and the pulse input on pin 4 of IC 50 leaves IC 50 by means of pin 9 and enters on pin 9 of IC 53. This pulse is outputted from pin 8 of IC 53 and triggers relays 67 and 68. When relay 67 is energized, current is provided to relay 69 which is a time delay relay that continues to conduct for the illumination of light 70 for a brief interval such as two or three seconds. While this is occurring, relay 68 which is now switched energizes relay 71 which is also a time delay relay of a slightly shorter interval than that of relay 69. The operation of relay 71 is such that lines 72 and 73 are brought into contact with each other thereby illuminating light 74.

The actuation of these various relays and the illumination of lights 70 and 74 occurs in a very accurately timed and orderly fashion. Once the third strike is delivered, light 70, by means of relays 67 and 69, will be illuminated and it is through relay 67 that relays 64 and 54, although in a deenergized condition, continue to illuminate lights 65 and 55, respectively. After a brief interval, for example, 3 seconds, relay 69 opens breaking the connection to line 60 and relay 67 returns to its normally closed condition. This then removes current from light 70, light 65 and light 55. However, during this 3-second interval, relay 68 has switched to a conducting state and energized relay 71. Relay 71 does not make contact between lines 72 and 73 for an interval of time such as 2½ seconds which is fractionally shorter than the time interval that the three strike lights remain on. Consequently what occurs is that all three strike lights and the first out light 74 are all illuminated for roughly a half a second, thereafter lights 70, 65 and 55 are deenergized and light 74 remains on.

Relay 69 is arranged in a manner (electrically wired) such that once relay 67 is energized and current is delivered to relay 69, a reset pulse via line 69*a* is delivered to the IC of the ball-counting circuitry which corresponds to IC 50. This reset pulse, once applied to this corresponding IC, returns the ball lights then illuminated to their OFF condition. A similar wiring arrangement is provided as part of the ball-counting circuitry for resetting of the then-existing strike count when the fourth ball is recorded.

As the individual continues to throw practice pitches and switch 47 is again triggered, IC 49 returns from D back to A and the pulse is input on pin 3 of IC 50 and leaves by way of pin 13 of IC 50. The pulse then connects to pin 12 of IC 53 as well as pin 2 of IC 77. The output from IC 53 is from pin 11 which returns to energize relay 54 as has been previously discussed. The pulse directed to IC 77 (which is also a 7408) leaves from pin 3 and connects to relay 78 which in turn sends current back to relay 68 in a manner similar to what has previously been described in order to maintain light 74 in an "on" condition. Thus, while the fourth strike is being registered and light 55 illuminated, light 74, which indicates in addition to the one strike that there is also one out, remains on.

When the fifth strike is thrown, switch 47 is again triggered and this time IC 49 changes from A to B and the output from pin 9 travels to pin 6 of IC 50 and from pin 6 out pin 14 which connects to pins 5 and 9 of IC 77. The pulse input on pin 5 leaves by way of pin 6 and energizes relay 64 as previously described to register the second strike leading up to the second out. When this occurs, current is also provided back to relay 54 in order to maintain light 55 on. The pulse input on pin 9 of IC 77 leaves by way of pin 8 to energize relay 79. The energizing relay 79 results in sending current back through relay 78 and in turn through relay 68 to maintain relay 71 in an energized state such that light 74 remains on.

When the sixth strike is recorded and switch 47 triggered, IC 49 changes from B to C and the input on pin 7 of IC 50 leaves IC 50 by way of pin 11. This pulse is then coupled to pin 12 of IC 77 and pin 2 of IC 80. The pulse in on pin 12 of IC 77 leaves by way of pin 11 and results in energizing relay 67 and 69 and the illumination of light 70 for the third strike. The same energizing sequence as previously described for the first out also occurs by way of relay 68, relay 71, lines 72 and 73 and light 74. The pulse in on pin 2 of IC 80 (a 7408) leaves by way of pin 3 and couples to relay 81 which is energized and sends current to light 82. Light 82 is the indicator light for the second out and while relay 81 is energized, it sends current back through relay 79, relay 78 and relay 68 which keeps relay 71 closed for a complete circuit in order to keep light 74 illuminated. After brief interval time lights 55, 65 and 70 are deenergized and the system is then ready to record the third out.

When the seventh strike is thrown and switch 47 triggered, the pulse changes IC 49 from C to D and the signal in on pin 4 of IC 50 leaves by way of pin 10 and the pulse is connected to pins 5 and 9 of IC 80. The pulse in on pin 5 leaves by way of pin 6 and energizes relay 54 for the illumination of light 55. The pulse in on pin 9 leaves by way of pin 8 and connects to relay 85 and sends current back through relays 81, 79, 78 and 68 and to time delay relay 71 in order to keep lights 82 and 74 in an illuminated condition for recording outs one and two. When the eighth strike is thrown, the signal from IC 49 leaves by pin 12 and the corresponding pulse leaves IC 50 from pin 1. Pin 1 in turn couples to pin 12 of IC 80 and pin 2 of IC 86 (a 7408). The input pulse on pin 12 of IC 80 leaves by way of pin 11 and couples to relay 64 for the illumination of light 65. The pulse in on pin 2 of IC 86 leaves by way of pin 3 and couples to relay 87. Relay 87 then sends current back through relays 85, 81, 79, 78 and 68 in order to maintain lights 74 and 82 in an illuminated condition.

Figure 6:
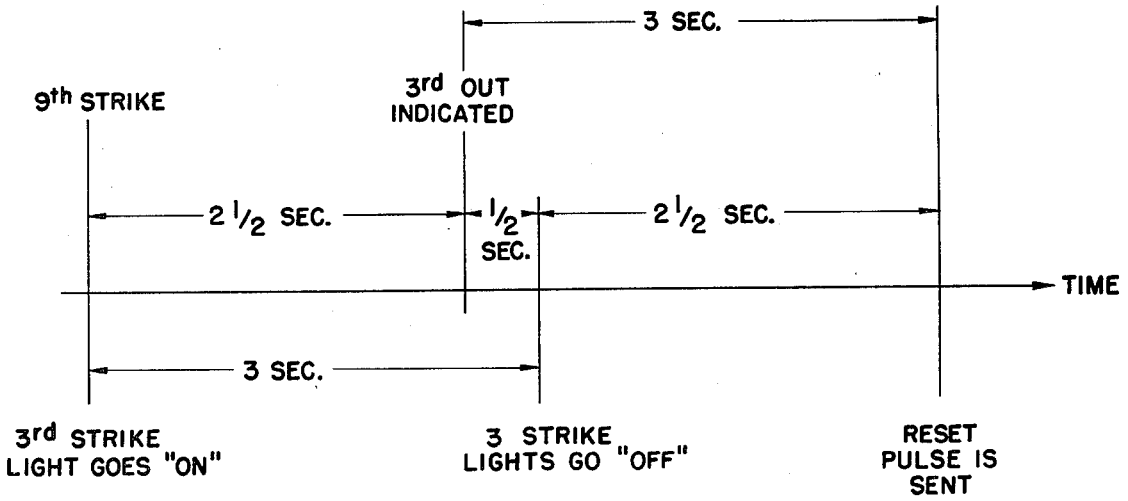
FIG. 6 is a diagrammatic representation of the time relation between circuit actions.

At this point, the apparatus indicates that there are two outs and two strikes and upon throwing the third strike, the inning will be over and the apparatus reset in order to begin a new inning. This recording of the ninth strike (the third out) occurs in the following manner. Upon triggering switch 47, IC 49 changes from A to B and the pulse out on pin 9 couples to pin 6 of IC 50 and from there leaves by way of pin 2 which couples to pin 5 and pin 9 of IC 86. The pulse in on pin 5 leaves by way of pin 6 and couples to relay 67 for energizing light 70. The pulse in on pin 9 leaves by pin 8 and couples to relay 88 for energizing light 89. With the energizing of relay 88, time delay relay 90 is also energized and includes two separate connecting lines. Lines 91 and 92 when coupled together provide the current for the illumination of light 89. Lines 93 and 94 when coupled together send a reset pulse signal back to a point just downstream from switch 47 and this resets the entire machine. Line 93 couples to one side of the incoming AC (line 61) and line 94 couples to time delay relay 108. Once relay 108 is energized, lines 109 and 110 complete the reset circuitry. The closing of lines 109 and 110 sends the pulse to the downstream side of switch 47. By delaying the closing of lines 109 and 110 for approximately three seconds, there will be a brief time interval when three outs are indicated before a complete reset and a new inning begins. Thus, for this brief time interval, the user is aware that three outs have been recorded. FIG. 6 diagrammatically represents a time axis for the events following the delivery of the ninth strike.

The FIG. 5 illustration focuses on that additional circuitry required with the ball-counting circuit section in order to record the fourth ball and provide a walk count. Although the circuitry for the first three balls will be virtually the same as for the first three strikes, the fourth ball is recorded by energizing relay 97 which in turn maintains the current on the other three relays and consequently, on the first, second and third ball-indicating lights. Time delay relay 98 initially energizes thereby closing lines 99 and 100 for energizing light 101 and lines 102 and 103 close thereby energizing relay 105. Relay 105 remains open for a brief period of time, such as 1½ seconds. When relay 105 closes, a pulse signal is coupled to walk counter 104 and to the strike reset IC of the strike-counting circuitry. After a brief time interval of approximately 2 seconds, relay 98 opens thereby removing energizing current from all four ball-indicating lights. Since the inning is not over until such time as the third out is recorded, the circuitry previously described involving relay 88 and relay 90 is the only portion of the circuitry which results in resetting the entire system. However, once a third strike is recorded, any balls recorded up to that time are erased as part of the resetting procedure. Similarly, when the fourth ball is recorded, any strikes which have been recorded up to that point are erased from the display circuitry. With a new batter both the ball and strike counts must begin again at zero. The time intervals of 1½ and 2 seconds result in the fourth ball light coming ON immediately and remaining on for 2 seconds. After 1½ seconds, the existing strikes are reset and the walk counter advances by one. Thereafter, the ball lights all go OFF. With respect to the ball-counting circuit section pulse which is coupled back to the resets of the various integrated circuits of the strike-counting circuit section, it is important that the outs already recorded are not reset but only the strike count as of the time that the fourth ball is registered.

Counter 104 represents a digital device having a direct readout of the total number of walks delivered by the pitcher. This counter advances by one each time a fourth ball is pitched to the same imaginary batter (before the third strike). Counter 104 and the series of lights 29 are both illustrated in FIG. 1 and FIG. 5 and it is to be understood that either arrangement may be used individually as well as together. When both are used, the series of lights reset after each inning and the counter resets only when the apparatus is turned OFF.

A variety of adaptations are anticipated based on the ideas disclosed herein. For example, it is anticipated that the display circuitry 22 could be arranged to show the total number of strikes and the total number of balls thrown as well as the number of innings pitched. It is envisioned that the various pulses generated by the circuitry disclosed herein could be arranged such that each resetting pulse generates one count so that the total number of innings could be recorded so that a pitcher would have some indication of his pitching stamina. It is also envisioned that slightly different circuitry arrangements could be employed embodying the same idea and concepts being disclosed herein and these alternative arrangements are also desired to be protected.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A practice pitching apparatus which maintains a count of balls, strikes and outs comprises:

an upright target member having a front surface arranged into a strike zone and a surrounding ball zone, said target member including a supporting frame, a plurality of spring-biased impact panels, and a plurality of switches supported by said frame and disposed directly behind said impact panels, said plurality of spring-biased impact panels including a first panel arranged to provide said strike zone and a second series of panels arranged to provide said surrounding ball zone;

a strike-counting circuit section responsive to ball impact on said first panel;

an out-counting circuit section coupled to and cooperatively arranged with said strike-counting circuit section;

a ball-counting circuit section responsive to ball impact on said second series of panels;

display means for indicating the number of strikes and the number of balls thrown;

said plurality of switches including a first group arranged in parallel and comprising a portion of said strike-counting circuit section and a second group arranged in parallel and comprising a portion of said ball-counting circuit section; and said first group of switches is subdivided into a first subgroup of switches arranged behind said strike zone panel and a second subgroup of switches arranged behind said ball zone panels, said first subgroup operatively arranged to energize said strike-counting circuit section, said second subgroup operatively arranged to disable said strike-counting circuit section.

2. The practice pitching apparatus of claim 1 wherein said second groups of switches is subdivided into a third subgroup of switches arranged behind said ball zone panels and a fourth subgroup of switches arranged behind said strike zone panels, said third subgroup operatively arranged to energize said ball-counting circuit section, said fourth subgroup operatively arranged to disable said ball-counting circuit section.

* * * * *